United States Patent [19]

Ivancic

[11] 4,204,498

[45] May 27, 1980

[54] APPARATUS FOR APPLYING COATING LIQUID TO ARTICLES

[76] Inventor: Emil Ivancic, 26 Frolick Crescent, Scarborough, Ontario, Canada, M1G 3E7

[21] Appl. No.: 911,132

[22] Filed: May 31, 1978

[51] Int. Cl.[2] ..... B05C 11/00; B05C 11/10

[52] U.S. Cl. ..... 118/693; 118/421; 118/428; 118/503; 427/430.1

[58] Field of Search ..... 427/430 R; 118/7, 421, 118/428, 503

[56] References Cited

U.S. PATENT DOCUMENTS

| | | | |
|---|---|---|---|
| 142,728 | 9/1873 | Reagan | 118/421 X |
| 418,801 | 1/1890 | Lorimer | 118/421 X |
| 1,119,271 | 12/1914 | Gell | 118/428 |
| 1,724,179 | 8/1929 | Bullerjahn | 118/428 |
| 1,947,689 | 2/1934 | Young | 118/59 |
| 2,771,049 | 11/1956 | Fish | 118/421 |
| 2,887,087 | 5/1959 | Jones | 118/7 |
| 3,097,961 | 7/1963 | Duperriez | 118/421 |
| 3,190,260 | 6/1965 | Merker | 118/3 |
| 3,365,326 | 1/1968 | Conrad | 118/7 X |
| 3,557,749 | 1/1971 | Farago | 118/7 |
| 3,639,142 | 2/1972 | Maxwell et al. | 118/503 X |
| 3,675,622 | 7/1972 | Griffin | 118/421 |
| 3,737,338 | 6/1973 | Kabelitz | 118/7 X |
| 3,848,439 | 11/1974 | Lopata | 68/184 |
| 3,948,213 | 4/1976 | Hoyer et al. | 118/428 X |

*Primary Examiner*—Shrive P. Beck

*Attorney, Agent, or Firm*—Ridout & Maybee

[57] ABSTRACT

To provide an improved apparatus for, and method of, applying paint to an article, particularly where it is desired that only a portion of the article have the paint applied thereto, a pump continuously supplies the paint from a storage tank to a chamber while the apparatus is in operation, with the paint returning from the chamber to the storage tank by way of an overflow pipe provided by the chamber, thereby to maintain at a predetermined level the paint in the chamber and in an associated bath in which the article to be painted is mounted. While the overflow pipe is closed by a normally open valve a displacement member is moved in the chamber below the predetermined level thereby to displace the paint in the chamber and in the bath to a level above this predetermined level with resultant application of the paint to the article. In this manner the disadvantage of a series of the articles requiring to be dipped into the associated paint bath to progressively lower levels as the paint in the bath is progressively exhausted is overcome.

12 Claims, 3 Drawing Figures

APPARATUS FOR APPLYING COATING LIQUID TO ARTICLES

Figure 1:
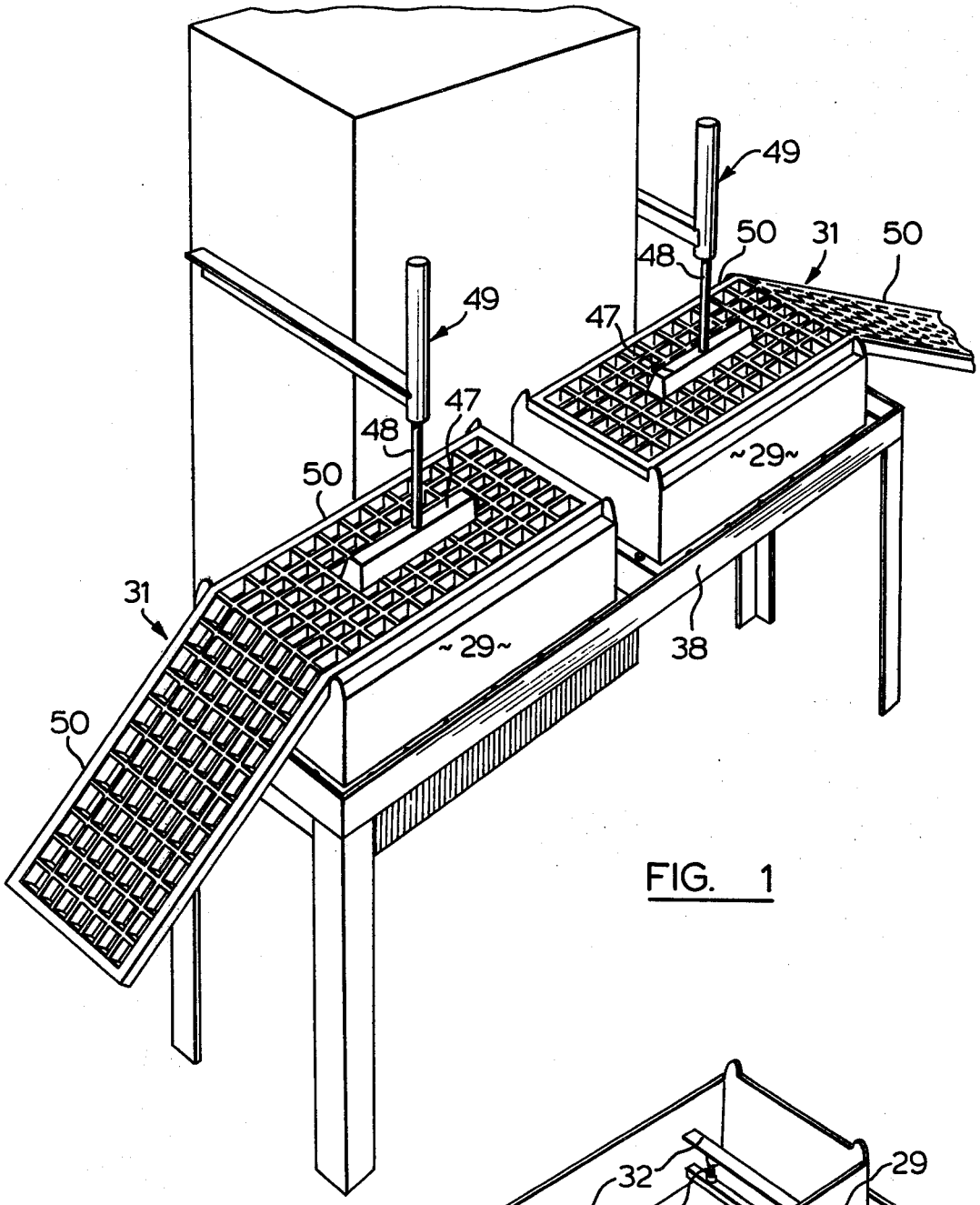

This invention is concerned with apparatus for applying to articles a coating liquid such as, for example, paint.

It has of course hitherto been known to apply a coating of paint to articles by dipping the articles into a bath of liquid paint, and this procedure is particularly suited to applying paint to articles where it is desired that only a portion of each article have the paint applied thereto and the article can be so oriented that the desired boundary between the portion of the article to be painted and the remaining portion of the article which is to remain unpainted is horizontally disposed, the article being dipped into the liquid paint in the bath only to the extent that the paint level coincides with the above-mentioned desired boundary. In this manner masking of the portion of the article to remain unpainted and which would be required if the paint was to be applied by spray painting is unnecessary, and this is particularly advantageous where the portion of the article which is to remain unpainted is of intricate shape and would accordingly be difficult or at least time consuming to mask.

It is, however, a disadvantage of such a dip painting procedure as conventionally used hitherto that as a series of the articles is painted the supply of liquid paint in the bath is of course progressively exhausted, with the result that if only a portion of each article is to be painted as described hereinabove and the boundary between the painted and unpainted portions is to be maintained at a constant position in the series of articles it is necessary for the operator to dip the articles to progressively lower levels within the bath, until of course of supply of liquid paint in the bath is replenished. This requires considerable skill on the part of the operator and is a time consuming operation, and it is a primary object of the present invention substantially to overcome or mitigate this disadvantage by providing apparatus for applying to articles a coating liquid such as, for example, paint in which the level of the liquid paint is in a novel manner automatically disposed at a constant level during the painting of each article.

According to the present invention there is provided apparatus for applying a coating liquid, the apparatus comprising a container for coating liquid in which articles to be coated by the liquid are mountable, a storage tank for the liquid, a pump having an inlet in communication with the storage tank and an outlet in communication with the container for continuously supplying the liquid from the storage tank to the container while the apparatus is in operation, an overflow means provided by the container and by which the liquid may return from the container to the storage tank for maintaining the liquid in the container at a predetermined level, a valve associated with the overflow means and having a normally open condition in which the valve permits return of the liquid by way of the overflow means from the container to the storage tank, and a closed condition in which the valve prevents return of the liquid by way of the overflow means from the container to the storage tank, and a displacement member mounted for movement within the container to displace the liquid therein above said predetermined level when the valve is in the closed condition thereof.

Figure 3:
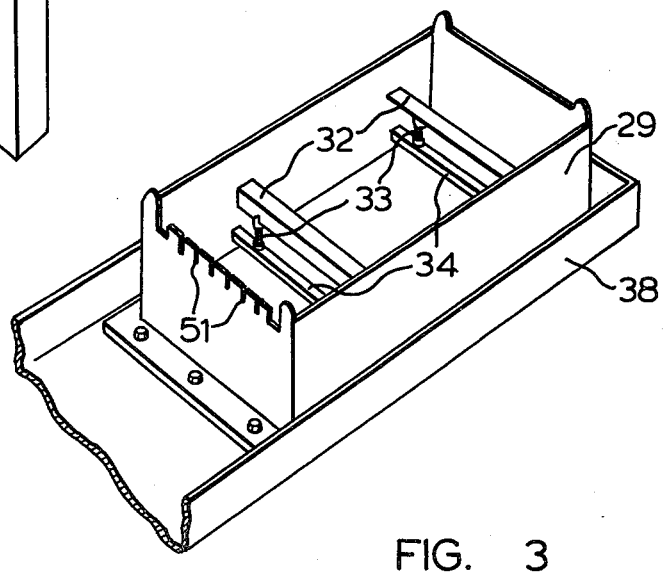
Figure 2:
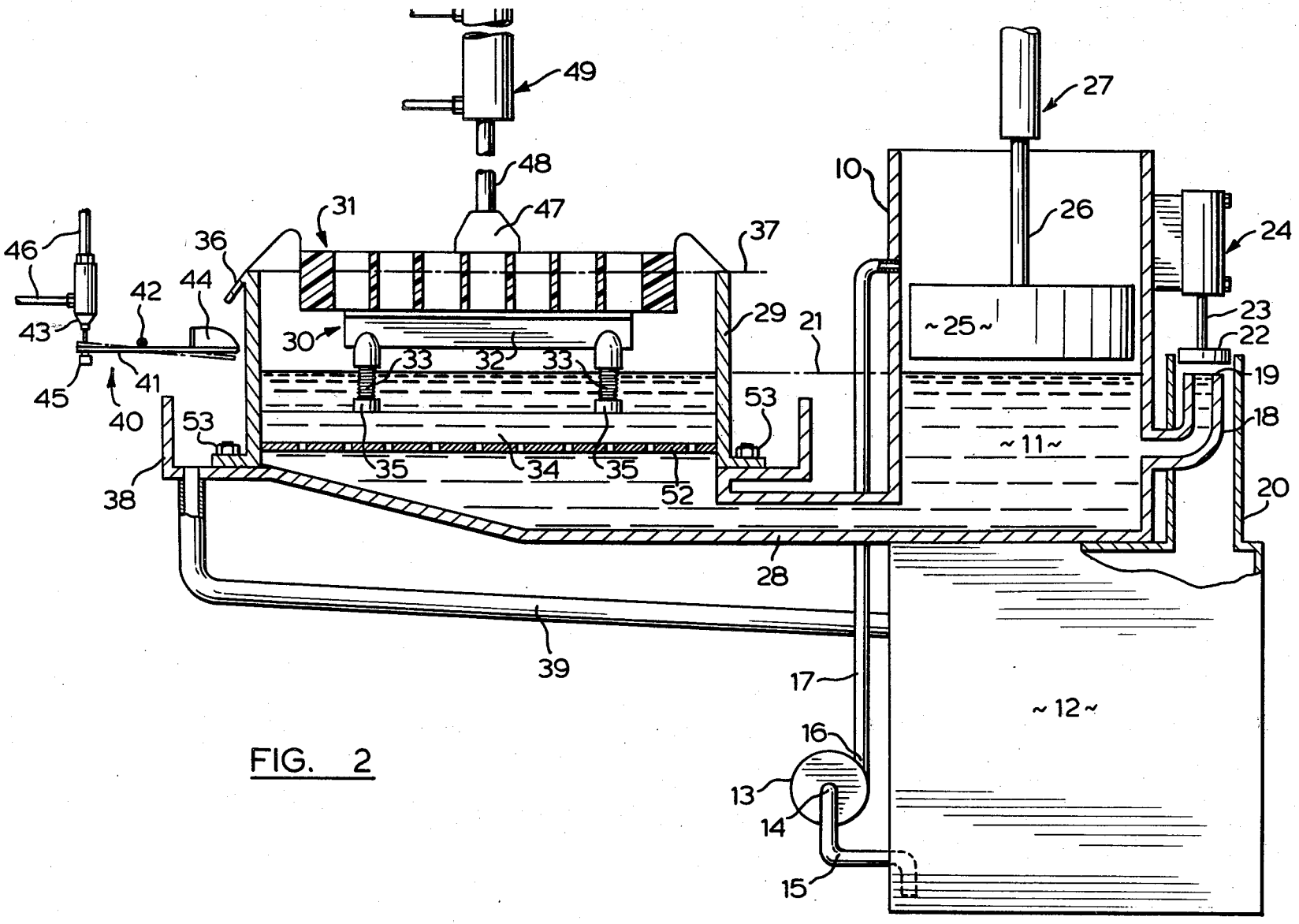

In order that the invention may be more clearly understood and more readily carried into effect the same will now, by way of example, be more fully described with reference to the accompanying drawings in which FIG. 1 is a view of apparatus according to a preferred embodiment of the invention;

FIG. 2 is a somewhat diagrammatic, sectioned view of the apparatus shown in FIG. 1; and FIG. 3 is a view of a portion of the apparatus shown in FIGS. 1 and 2.

Referring to the drawings and with particular reference to FIG. 2 thereof, 10 denotes generally a chamber for paint 11 or other coating liquid. A storage tank 12 for the paint 11 is disposed below the chamber 10, with a pump 13 which may be of conventional form being provided with its inlet 14 connected by a pipe 15 to the lower portion of the interior of the storage tank 12 and its outlet 16 connected by a pipe 17 to the interior of the chamber 10. A paint agitator (not shown) which may be of conventional form is preferably mounted within the storage tank 12.

The chamber 10 is provided with an overflow means which in the preferred embodiment shown in the drawings is constituted by an overflow pipe 18 of elbow form, the lower end thereof being in communication with the interior of the chamber 10 and the upper end 19 thereof being normally open. The pipe 18 is disposed through the wall of an upwardly extending tube 20 presented by the storage tank 12 with the upper open end 19 of the pipe 18 within the tube 20, so that with the apparatus in operation during which the pump 13 continuously supplies the paint 11 from the storage tank 12 to the chamber 10 the paint 11 normally overflows from the upper open end 19 of the pipe 18 and returns down the tube 20 to the storage tank 12 thereby to maintain the paint 11 in the chamber 10 at a predetermined level 21 which is at the same level as the upper open end 19 of the pipe 18.

The overflow pipe 18 is provided with a normally open valve comprising, in the preferred embodiment shown in the drawings, a closure member 22 mounted on the piston rod 23 of a pneumatically or hydraulically operable piston and cylinder assembly 24 for movement of the closure member 22 between a normally open condition of the valve (as shown in FIG. 2) in which the closure member 22 is spaced from the open end 19 of the pipe 18 and a closed condition of the valve in which the closure member 22 is in sealing engagement with the open end 19 of the pipe 18. The pipe 18 may be so vertically adjustable by, for example, having an upper end portion which is screw-threadedly mounted on the remainder thereof that the level of the upper end 19 of the pipe 18 may be altered correspondingly to alter the level 21, the setting of the normally open valve being, if necessary, correspondingly adjustable.

In alternative embodiments (not shown) the overflow means may, for example, be constituted by an overflow weir with the associated normally open valve being, for example, of the gate type.

A displacement member 25 mounted on the piston rod 26 of a pneumatically or hydraulically operable piston and cylinder assembly 27 is disposed for movement within the chamber 10 between a position (as shown in FIG. 2) above the level 21 and a position below the level 21.

The chamber 10 is in communication through a pipe 28 below the level 21 with a bath 29 so that, since the bath 29 and also the chamber 10 are open to the atmosphere, the level of the paint 11 in the bath 29 is normally also at the level 21. There is mounted within the bath 29 a support 30 for articles 31 to be coated by the paint 11, this support 30 which may be constituted by a plurality of spaced, transversely extending members 32 as most clearly shown in FIG. 3 preferably being vertically adjustable to adjust the level at which the articles 31 are supported by, for example, screw-threaded members 33 which are disposed through fixed support beams 34 and which have mounted thereon rotatable lock nuts 35.

Although it is not an essential feature of the present invention the bath 29 is preferably provided with an overflow lip 36 at a level 37 disposed above the level 21, an overflow trough 38 which is disposed below the lip 36 and surrounds the bath 29 and which is in communication by way of a pipe 39 with the storage tank 12 being provided for returning paint 11 discharged from the bath 29 over the lip 36 to the storage tank 12, when the apparatus is in use as hereinafter described.

In alternative embodiments (not shown), the tube 20 may be omitted with the paint 11 normally overflowing from the upper open end 19 of the pipe 18 into a trough (not shown) mounted on the chamber 10, this trough mounted on the chamber 10 being in communication with the trough 38 so that with the apparatus in operation the paint 11 which normally overflows from the upper open end 19 of the pipe 18 returns by way of the trough mounted on the chamber 10, the trough 38 and the pipe 39 to the storage tank 12 to maintain the paint 11 in the chamber 10 at the level 21.

Disposed below the overflow lip 30 there is preferably provided a control switch which is denoted generally by the reference numeral 40 and which is operatively actuated by paint 11 discharged over the overflow lip 36, the switch 40 preferably comprising a member 41 which is pivotally mounted about a pivot pin 42 for movement between a first position (shown in full lines) in which the member 41 is spaced from a gas sensor 43 so that the gas sensor 43 is uninfluenced by the member 41, and is preferably open, and a second position (shown in chain-dotted lines) in which the gas sensor 43 is actuated, and is preferably closed, by the member 41. The end of the member 41 remote from the end thereof which operatively actuates the gas sensor 43 when the member 41 is in the second position is provided with a tray-like member 44 which is in the path of paint 11 operatively discharged over the overflow lip 36, whereby such paint 11 impinges on the member 44 with resultant pivotal movement of the member 41 from its first position to its second position, the member 41 being urged toward its first position by a counterweight 45 mounted on the end of the member 41 which operatively actuates the gas sensor 43. The gas sensor 43 is connected in a pressurized gas line 46 which so controls operation of the piston and cylinder assemblies 24 and 27 that alteration in the pressure in the gas line 46 resultant from actuation of the gas sensor 43 when the member 41 moves from its first position to its second position causes operation of the piston and cylinder assembly 24 to move the closure member 22 from the closed condition of the valve to the open condition thereof and causes operation of the piston and cylinder assembly 27 to move the displacement member 25 in the direction from below the level 21 to above the level 21.

A clamping member 47 may be provided for clamping the articles 31 against the support 30, the clamping member 47 being mounted on the piston rod 48 of a pneumatically or hydraulically operable piston and cylinder assembly 49 the operation of which is preferably also controlled by the switch 40 such that movement of the member 41 from its first position to its second position results in operation of the piston and cylinder assembly 49 to raise the clamping member 47 away from the clamping contact with the article 31 disposed on the support 30. Power operating means other than the piston and cylinder assembly 49 may of course be provided for the clamping member 47, and likewise power operating means other than the piston and cylinder assemblies 24 and 27 may be provided for the closure member 22 and the displacement member 25, respectively.

The clamping member 47 serves during the painting cycle as hereinafter described to prevent any tendency for the articles 31 operatively to float on the paint 11 which could result if the articles 31 are of relatively low specific gravity. Furthermore, where the articles 31 are of a resiliently deformable material such as a moulded plastics material and are normally of other than planar form the clamping member 47 may serve resiliently to stress the articles 31 into a planar condition during the painting thereof in order to ensure that the paint 11 is applied to each article 31 to a constant depth.

FIG. 1 shows apparatus in which there are two baths 29 each of which is of the form hereinbefore described with particular reference to FIG. 2.

As hereinbefore described, when the apparatus is in operation the pump 13 continuously supplies paint 11 from the storage tank 12 to the chamber 10, the paint 11 returning through the overflow pipe 18 and either down the tube 20 or by way of the trough 38 and the pipe 39 to the storage tank 12 thereby normally to maintain the paint 11 in the chamber 10 and in the bath 29 at the level 21. To apply a coating of the paint 11 to one of the articles 31 the article 31 is mounted on the support 30, and by actuation of a switch (not shown) which controls the operation of the piston and cylinder assemblies 24, 27 and 49 the assembly 49 is so operated as to bring the clamping member 47 into clamping contact with the article 31, the assembly 24 is so operated as to move the closure member 22 from the open condition of the valve in which the valve permits return of the paint 11 by way of the overflow means from the chamber 10 to the storage tank 12 to the closed condition thereof, in which the valve prevents return of the paint 11 by way of the overflow means from the chamber 10 to the storage tank 12, and the assembly 27 is so operated as to move the displacement member 25 from above the level 21 to below the level 21. Since the valve is in its closed condition such movement of the displacement member 25 results in the paint 11 in the chamber 10 and in the bath 29 being displaced from the level 21 to the level 37 thereby to immerse in the paint 11 the portion of the article 31 below this level 37, a perforated plate 52 preferably extending across the bath 29 to prevent or at least minimize any tendency for the paint 11 in being so displaced from the level 21 to the level 37 surging above the level 37. In fact, in the preferred embodiment of the invention as herein described with reference to the accompanying drawings the volume of the displacement member 25 is such that if the side walls of the bath 29 extended above the level 37 the above-described movement of the displacement member 25 from above the level 21 to below the level 21 would result in the paint 11 in the bath 29, and in the chamber 10, being displaced to a level slightly above the level 37, so that when the paint 11 attains the level 37 some of the paint is then discharged over the overflow lip 36 to actuate the control switch 40 with resultant operation of the assemblies 49, 27 and 24 to raise the clamping member 47 from clamping contact with the article 31, to return the displacement member 25 from below the level 21 to above the level 21, and to return the closure member 22 from the closed condition to the open condition of the valve, respectively. The article 31 may then be removed, and the apparatus is thereby again in its initial condition ready for the above-described sequence of operations to be repeated.

As shown in the drawings the articles 31 may be constituted by, for example, radiator grilles for automobiles, each of these radiator grilles comprising two adjacent, relatively inclined portions 50 only one of which is painted in a single painting operation, as will be noted from FIG. 1. Slots 51 in the bath 29, as shown in FIG. 3, accommodate the elements of each grille at the junction between the two relatively inclined portions 50 of the grille during the painting cycle. As shown in the drawings the side walls of the bath are preferably removably mounted by means, for example, of nut and bolt assemblies 53, thereby permitting the replacement of these side walls by side walls of different dimensions and/or configurations to accommodate articles 31 of different dimensions and/or configuration.

While as hereinbefore described with reference to the accompanying drawings the bath 29 and the chamber 10 are distinct elements of the apparatus it will of course be appreciated that in alternative embodiments (not shown) the chamber 10 and the bath 29 may together be constituted by a combined container. Furthermore, while in the preferred embodiment the bath 29 is provided with the overflow lip 36 and there is provided the control switch 40 for controlling operation of the piston and cylinder assemblies 24, 27 and 49 as hereinabove described in alternative embodiments (not shown) this overflow lip 36 may be omitted with the walls of the bath 29 extending above the level 37, the movement of the displacement member 25 from above the level 21 to below the level 21 still displacing the paint 11 in the chamber 10 and in the bath 29 to a predetermined level dependent on the volume of the displacement member 25. In this case, of course, means other than the control switch 40 is provided for operation of the assemblies 49, 27 and 24 to raise the clamping member 47 from clamping contact with the article 31, to move the displacement member 25 from below the level 21 to above the level 21, and to return the closure member 22 from the closed condition of the valve to the open condition thereof, respectively, at the completion of the painting cycle.

What I claim as my invention is:

1. Apparatus for applying a coating liquid, the apparatus comprising a container for coating liquid in which articles to be coated by the liquid are mountable, a storage tank for the liquid, a pump having an inlet in communication with the storage tank and an outlet in communication with the container for continuously supplying the liquid from the storage tank to the container while the apparatus is in operation, an overflow means provided by the container and by which the liquid may return from the container to the storage tank for maintaining the liquid in the container at a predetermined level, a valve associated with the overflow means and having a normally open condition in which the valve permits return of the liquid by way of the overflow means from the container to the storage tank, and a closed condition in which the valve prevents return of the liquid by way of the overflow means from the container to the storage tank, and a displacement member mounted for movement within the container to displace the liquid therein above said predetermined level when the valve is in the closed condition thereof.

2. Apparatus for applying a coating liquid, the apparatus comprising a chamber for coating liquid, a storage tank for the liquid, a pump having an inlet in communication with the storage tank and an outlet in communication with the chamber for continuously supplying the liquid from the storage tank to the chamber while the apparatus is in operation, a bath in which articles to be coated by the coating liquid are mountable and which is in communication with the chamber below a predetermined level, overflow means provided by the chamber and by which the liquid may return from the chamber to the storage tank for maintaining the liquid in the chamber and in the bath at said predetermined level, a valve associated with the overflow means and having a normally open condition in which the valve permits return of the liquid by way of the overflow means from the chamber to the storage tank, and a closed condition in which the valve prevents return of the liquid by way of the overflow means from the chamber to the storage tank, and a displacement member mounted for movement within the chamber to displace the liquid therein and in the bath above said predetermined level when the valve is in the closed condition thereof.

3. Apparatus according to either one of claims 1 or 2, wherein the overflow means is vertically adjustable for altering said predetermined level.

4. Apparatus according to either one of claims 1 or 2, wherein the overflow means comprises an overflow pipe having an open end, and the valve comprises a closure member movable between a position in which the valve is in the open condition in which the closure member is spaced from said open end of the overflow pipe, and a position in which the valve is in the closed condition in which the closure member is in sealing engagement with said open end of the overflow pipe.

5. Apparatus according to claim 2, wherein the bath has an overflow lip at a level above said predetermined level.

6. Apparatus according to claim 5, wherein an overflow trough which is in communication with the storage tank is disposed below the overflow lip for returning coating liquid discharged from the bath over the overflow lip to the storage tank.

7. Apparatus according to either one of claims 5 or 6, wherein a control switch is disposed below the overflow lip for actuation by coating liquid discharged over the overflow lip, the switch being so connected in circuit with power operating means for the displacement member and the valve that said actuation of the switch causes said movement of the displacement member to displace the liquid above said predetermined level to be reversed and causes operation of the valve into the open condition thereof.

8. Apparatus according to claim 7, wherein the control switch comprises a pivotally mounted member disposed below the overflow lip and a gas sensor connected in a pressurized gas line, the pivotally mounted member being movable by liquid discharged over the overflow lip from a first position in which the gas sensor is uninfluenced by the pivotally mounted member to a second position in which the gas sensor is actuated by the pivotally mounted member with resultant alteration in the pressure in the gas line, and the pivotally mounted member being urged towards said first position thereof.

9. Apparatus according to claim 1, further comprising a support for said mounting of articles to be coated by the coating liquid within the container, the support being vertically adjustable to adjust the level at which articles are supported thereby.

10. Apparatus according to claim 9, further comprising a clamping member for clamping articles to be coated by the liquid coating against the support.

11. Apparatus according to claim 10, wherein the displacement member, the valve and the clamping member are pneumatically or hydraulically operable.

12. Apparatus according to claim 2, wherein a perforated plate extends across the bath for minimizing surging of the liquid in the displacement thereof above said predetermined level.

* * * * *